United States Patent [19]

Burgess

[11] Patent Number: 4,461,502

[45] Date of Patent: Jul. 24, 1984

[54] ADJUSTABLE BAR LOCK

[76] Inventor: Rollie M. Burgess, 716 N. 6th St., Blue Springs, Mo. 64015

[21] Appl. No.: 380,418

[22] Filed: May 20, 1982

[51] Int. Cl.[3] ..... E05C 17/30

[52] U.S. Cl. ..... 292/262; 292/DIG. 46

[58] Field of Search ..... 292/DIG. 46, 338, 339, 292/262, 305

[56] References Cited

U.S. PATENT DOCUMENTS

| | | | |
|---|---|---|---|
| 3,328,920 | 7/1967 | Cohen et al. | 292/262 X |
| 3,471,189 | 10/1969 | Ness | 49/449 X |
| 3,486,781 | 12/1969 | Crum | 292/262 |
| 3,615,114 | 10/1971 | Harris | 292/288 |
| 3,698,754 | 10/1972 | Means | 292/262 |
| 3,977,712 | 8/1976 | Northrop | 292/338 |
| 4,005,889 | 2/1977 | Patrick | 292/262 |
| 4,073,522 | 2/1978 | Tierney | 292/262 |
| 4,076,293 | 2/1978 | Valles | 292/338 |
| 4,358,758 | 11/1982 | Morton | 292/339 X |

FOREIGN PATENT DOCUMENTS

| | | | |
|---|---|---|---|
| 1019016 | 1/1977 | Canada | 292/339 |

*Primary Examiner*—Richard E. Moore

*Attorney, Agent, or Firm*—Litman, Day & McMahon

[57] ABSTRACT

An adjustable bar lock for use between an abutment member and a slidable member. The bar lock includes a base attached to the abutment member and an adjustable bar comprising a rigid first link pivotally attached to the base and telescopically connected to a rigid second link. The second link has a free end adapted for abutting the slidable member with the bar in a locked position. A retainer clip adapted for attachment to the abutment member is provided for releasably securing the adjustable bar in a pass position, whereby the slidable member may be moved from a closed to an open location. The adjustable bar is foldable between the locked and the pass positions.

3 Claims, 4 Drawing Figures

ADJUSTABLE BAR LOCK

BACKGROUND OF THE INVENTION

1. Field of the Invention

This invention relates to security devices and more particularly to an adjustable bar lock for a sliding window or door.

2. Description of the Prior Art

Slidable members that are movable along a path between an open and a closed location in sliding doors and windows are normally equipped with a locking device; but many standard locking devices are easy to force open despite being locked. In order to insure safety, numerous devices have been developed which maintain the slidable member in a closed location.

In particular, bar locks which extend longitudinally in the path of movement of the slidable member have been extensively employed both as primary security devices and as backups to locking devices provided with sliding doors and windows. Such bar locks offer several advantages. First of all, they are typically placed in compression when resisting an opening force applied to the slidable member, and hence tend to be relatively strong and capable of withstanding a substantial force. Secondly, a positive interface between the slidable member and an abutment member is effected. Further advantages of such bar locks lie in their relative simplicity of operation and manufacture. A person can generally tell at a glance whether a sliding door or window is locked depending upon the absence or presence of a bar lock in the path of movement of the slidable member. The presence of a bar lock may also serve to discourage an intruder from attempting passage through a respective sliding window or door.

The simplest bar locks comprise merely elongated members, for example thick wooden dowels or pipes, wedged between a slidable member and an abutment member. However, such devices are generally cut to fit only a particular size of sliding window or door, and do not include mechanisms for conveniently retaining them out of the way in their respective pass positions.

Another type of bar lock is exemplified by the Harris U.S. Pat. No. 3,615,114 which shows a locking apparatus comprising an inner bar and an outer bar telescopically connected. The outer ends of such bars respectively abut an abutment member and a slidable member. When the slidable member is in its closed location, the locking apparatus is placed between the slidable member and the abutment member, thereby locking the slidable member in the closed location. The Harris apparatus may be shortened and left in the path of the slidable member, thereby allowing only partial freedom of movement of the slidable member; or it may be shortened and removed completely from the path of the slidable member, but is then susceptible to being lost or misplaced. A disadvantage with this device is that no provision is made for retaining it in a pass position.

The Means U.S. Pat. No. 3,698,754 discloses a device which is locked in place by using an overcenter pivot. The device comprises a telescopic member and a rigid member connected by the overcenter pivot. The respective ends of the telescopic and rigid members are pivotally attached to the slidable and abutment members. The overcenter pivot allows the telescopic and rigid member to collapse in a vertical plane, substantially out of the path of the moveable slidable member. However, these links will be prevented from collapsing in a scissors-like manner to a position substantially parallel with each other unless they are approximately the same length. Thus, if the length of the adjustable link is altered, the shorter link will prevent the longer link from rotating to a vertical position to allow the door to completely open.

Therefore, prior devices tended to restrict the operation of sliding windows and doors, to be relatively complex in structure and manufacture or to lack adjustability and provisions for securing them in an out of the way position.

SUMMARY OF THE INVENTION

In the practice of the present invention, a bar lock is provided which includes a telescopically adjustable bar comprising first and second rigid links threadably interconnected. The first link is pivotally connected to a base adapted for mounting on an abutment member in a sliding door or window assembly. The second link includes a free end adapted for engaging a slidable member of the door or window assembly when the bar is in a locked position whereby the slidable member is maintained in a closed location.

The bar is foldable to a pass position out of a path of movement of the slidable member whereat it is releasably securable to the abutment member by a retainer clip attached thereto. With the adjustable bar in its pass position, the slidable member may be moved to an open location. The overall length of the bar is adjustable by rotating the first and second links relative to each other and the bar may be secured at a desired length by tightening a wing nut on the first link against the second link.

The principal objects of the present invention are: to provide a bar lock for locking a slidable member of a sliding door or window in a closed location; to provide such a bar lock which includes a bar which may be conveniently positioned out of the way when not in use; to provide such a bar lock which is adjustable to different sized doors and windows; to provide such a bar lock which positively locks a slidable member in a closed location; to provide such a bar lock which may be mounted on either a slidable member or an abutment member of a sliding door or window; to provide such a bar lock with a bar which is pivotally mounted on the slidable or the abutment member; to provide such a bar lock wherein pivotal movement of the bar is substantially limited to a plane formed by the slidable member and its path of movement; to provide such a bar lock which includes a clip for selectively retaining a bar in a pass position; to provide such a bar lock which may be mounted at a desired height on a sliding door or window assembly; to provide such a bar lock which includes first and second links telescopically and threadably interconnected for length adjustment; to provide such a bar lock which includes lock means for securing the first and second links together as a bar with a desired length; to provide such a bar lock with first and second links which form a rigid bar; to provide such a bar lock with resilient means on a free end of one of the links for engaging the slidable member or the abutment member; and to provide such a bar lock which is economical to manufacture, efficient in use, capable of a long operating life and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
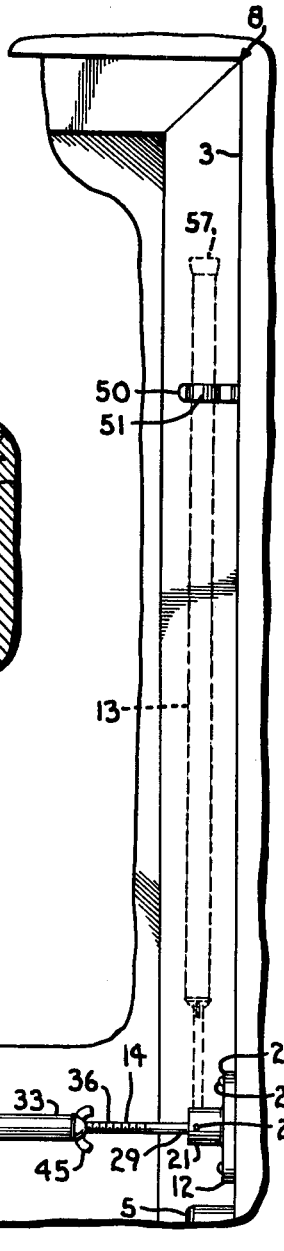
FIG. 2 is an enlarged front elevational view of the bar lock in a locked position and in a pass position in phantom.
Figure 3:
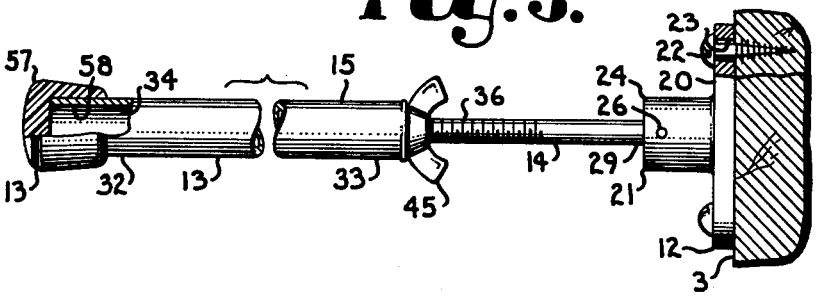
FIG. 3 is an enlarged fragmentary front elevational view particularly showing a telescopic engagement between a first and a second link of the bar lock with portions broken away to reveal internal construction.
Figure 4:
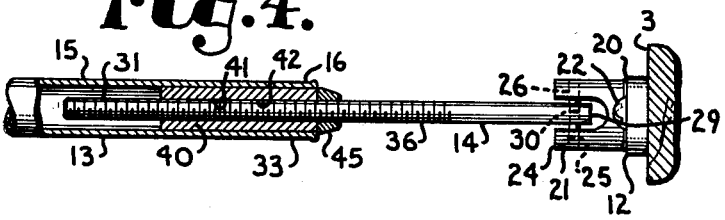
FIG. 4 is an enlarged fragmentary top plan view of the bar lock with portions broken away to reveal internal construction.
Figure 4:
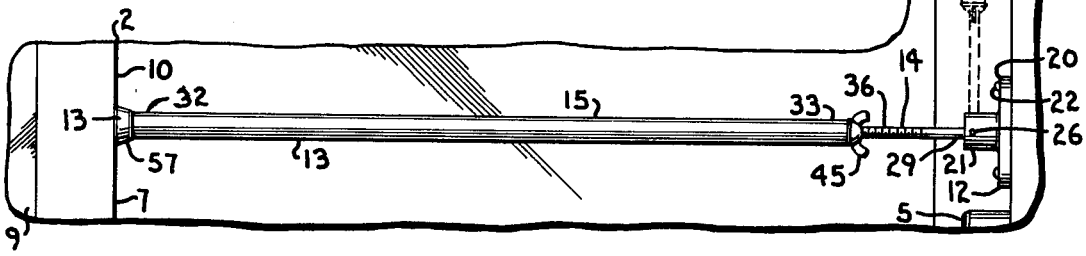

For purposes of description herein, the terms "upper", "lower", "right", "left", "vertical", "horizontal" and derivatives thereof shall relate to the invention as oriented in FIG. 2. However, it is to be understood that the invention may assume various alternative orientations, except where expressly specified to the contrary.

Figure 1:
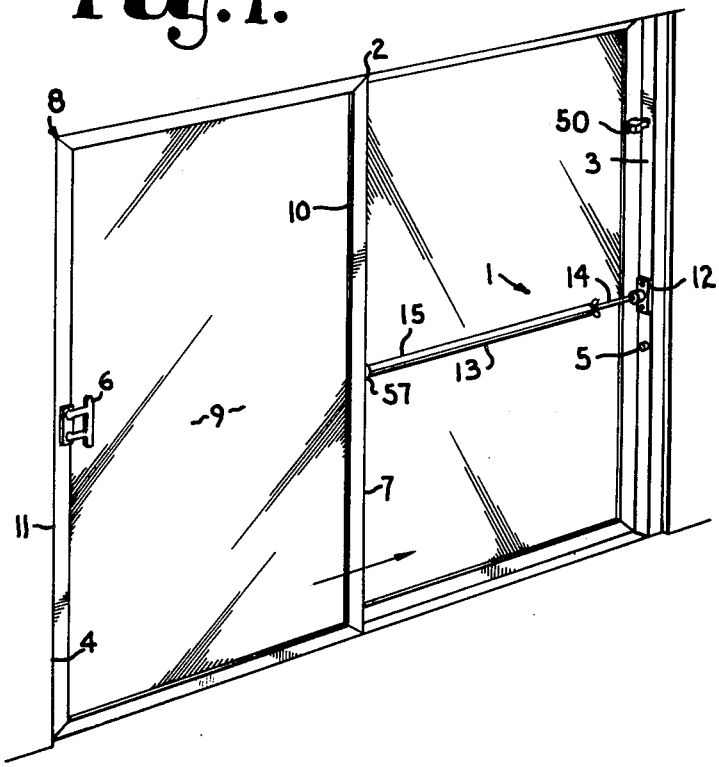
FIG. 1 is a perspective view of an adjustable bar lock embodying the present invention and attached to a sliding door assembly.

The reference numeral 1 generally designates an adjustable bar lock. The bar lock 1 is mounted on a conventional sliding door assembly 8 between a slidable member 2 and an abutment member 3 thereof. The slidable member 2 defines a vertical plane and comprises a glass panel 9 in a rigid frame 10. The slidable member frame 10 has an outer edge 11 with a handle 6 mounted thereon and an inner edge 7 opposite the handle 6. The slidable member 2 is movable in the vertical plane defined thereby along a linear path from a closed location, as shown in FIG. 1, to an open location (not shown) with its inner edge 7 in proximity to the abutment member 3.

The abutment member 3 comprises a door jamb lying substantially in the vertical plane defined by the slidable member 2 and operably limits the sliding movement of the slidable member 2. The slidable member inner edge 7 abuts a resilient bumper 5 on the abutment member 3 when the slidable member 2 is in its fully open location. With the slidable member 2 in its open location, a person can pass through the sliding door assembly 8. The slidable member outer edge 11 abuts an opposite door jamb 4 when the slidable member 2 is in its fully closed location and may be attached thereto by a lock mechanism (not shown) associated with the handle 6.

The bar lock 1 generally comprises an adjustable bar 13 including a rigid first link 14 and a rigid second link 15 interconnected by telescopic means 16. The adjustable bar 13 is pivotally connected to a base 12 mounted on the abutment member 3.

The base 12 comprises a flange portion 20 and a clevis portion 21. The flange portion 20 has a plurality of flange apertures 23 which receive respective screws 22 extending therethrough and into the abutment member 3, thereby attaching the base 12 to the abutment member 3. The clevis portion 21 comprises a pivot pin 26 and a pair of bifurcated arms 24 each having an aperture 25 therethrough for receiving the pivot pin 26.

The rigid first link 14 includes a length of threaded rod with external threads 36 thereon. A pivotal end 29 of the first link 14 has a bar aperture 30 therethrough adapted to receive the pivot pin 26 whereby the adjustable bar 13 is attached to the base 12 and pivotable relative thereto about a pivotal axis extending horizontally in a direction normal to the plane defined by the slidable member 2. Opposite its pivotal end 29 the first link 14 terminates at a telescopic end 31.

The rigid second link 15 displays opposite free and telescopic ends 32 and 33 respectively and has an elongated tubular configuration with a bore 34 extending therethrough and open at the ends 32 and 33. A plug 40 is fixedly secured in the second link bore 34 adjacent the second link telescopic end 33 and has an internally threaded plug bore 41 extending longitudinally therethrough with internal threads 42 and threadably receiving the first link telescopic end 31. The telescopic means 16 interconnecting the first and second links 14 and 15 respectively comprises the threadable engagement between the respective external and interal threads 36 and 42.

Locking means for securing the bar 13 at a desired predeterimed length comprises a wing nut 55 threadably receiving the first link 14. The wing nut 55 is adapted for being tightened against the plug 40 at the second link telescopic end 35 whereby relative rotation between the links 14 and 15 is prevented and the bar 13 retained at a predetermined overall length.

Adjustment of the overall length of the bar 13 is accomplished by rotating the wing nut 45 on the first link 14 in a direction such that it backs away from the plug 40 in the second link telescopic link 45. The links 14 and 15 can then be rotated relative to each other whereby the first link 14 is either inserted into the plug 41 (shortening the bar 13) or extracted therefrom (lengthening the bar 13), depending upon the direction of relative rotation between the links 14 and 15. The wing nut 45 is retightened against the plug 40 at the second link telescopic end 35 when the desired overall bar length is achieved.

A retainer clip 50 is provided for releasably securing the bar 13 in a pass position substantially parallel to and closely spaced from the abutment member 3. With the bar 13 in its pass position, the slidable member 2 may be slid to its fully open location with its inner edge 7 engaging the resilient bumper 5 without interference from the bar 13.

A retainer clip 50 is provided for releasably securing the bar 13 in its pass position and is attached to the abutment member 3 in spaced relation above the base 12 and in the plane defined by the slidable member 2. The retainer clip 50 comprises a resilient material, e.g. spring steel, formed into a desired configuration with a pair of spaced arms 51 extending outwardly from the abutment member 3 toward the slidable member 2 and forming an internal cavity 52 therebetween open at a clip opening 53. The internal cavity 52 is slightly narrower than an outside diameter of the second link 15 and the clip opening 53 is even smaller yet, whereby the second link 15 is resiliently retained within the internal cavity 52 by a gripping action of the arms 51 which are resiliently biased inwardly.

Attached to the second link free end 32 is a resilient cap 57 with a receiver 58 receiving the second link free end 32 therein. The cap 57 may be retained on the second link free end 32 by a resilient, gripping engagement therebetween, or a suitable adhesive may be utilized for effecting a connection. The cap 57 is somewhat compressible whereby a certain amount of force is applied to the slidable member to hold it in its closed location when the bar 13 is wedged in its locked position. The resiliency of the cap 57 also effects a frictional engagement with the slidable member inner edge 7 so that the bar 13 is prevented from slipping relative to the slidable member inner edge 7. Further, the cap 57 prevents the second link free end 32 from scratching the slidable member inner edge 7 and protects other things and persons from contact with sharp metal edges which may occur at the second link free end 32.

In operation, the pivotal engagement between the first link 14 and the base 12 substantially prevents movement of the bar 13 except about its pivotal axis which extends normal to the plane defined by the slidable member 2. Thus, the movement of the bar 13 between its locked and pass positions occurs substantially within this plane.

Use of the bar lock 1 is somewhat simplified by this feature of limiting the movement of the bar 13. For example, when the bar 13 is disengaged from the slidable member 2 and swung upwardly from its locked position, it is automatically guided into engagement with the clip 50. Upon engaging the clip 50, a slight push will part the arms 51 sufficiently for the second link 15 to enter the internal cavity 52 through the clip opening 53. Likewise, moving the bar 13 from its pass to its locked positions may be easily accomplished by merely disengaging its second link 15 from the clip 50 and allowing the bar 13 to pivot downwardly under its own weight through the plane defined by the slidable member. In fact, a person locking the sliding door assembly 8 may release the adjustable bar 13 from a position slightly tilted to the left of vertical whereby the bar 13 will automatically drop through an arc within the plane defined by the slidable member 2 to its locked position. The resilient cap 57 will thus frictionally engage the slidable member inner edge 7 so that the bar 13 is securely wedged between the slidable and abutment members 2 and 3 respectively.

Preferably, the overall length of the bar 13 is slightly greater than the spacing between the respective slidable and abutment members 2 and 3, so that the cap 57 engages the slidable member inner edge 7 slightly above the level of the adjustable bar pivotal axis. The bar 13 will thus be prevented from swinging downwardly further than its locked position. It will be appreciated that the threadable telescopic interconnection between the links 14 and 15 allows relatively precise adjustment of the overall length of the bar 13, whereby the bar 13 will consistently drop to its locked position under the influence of gravity and be retained there without other stop means for limiting its downward swing.

In its locked position, the adjustable bar 13 effects a positive lock against movement of the slidable member 2 from its closed location. An attempt to force the slidable member 2 open, as by a would-be intruder, places the bar 13 in compression. Against such a compressive force, the bar 13 is capable of exerting a great deal of resistance to prevent sliding of the slidable member 2. The relatively high compressive strength of the bar 2 is attributable in part to its construction of a relatively high strength material, e.g. steel, and also to its configuration with the second link 15 comprising a majority and a portion of the the first link extending therefrom comprising a minority of the overall length of the bar 13. This configuration contributes to the strength of the bar 13 because the tubular second link 15 offers considerably more strength and resistance to buckling due to its greater diameter than the threaded rod first link 14.

By maintaining a relatively high ratio of lengths for the second link 15 relative to the first link 14, the greater strength and resistance to buckling of the second link 15 is utilized to enhance these characteristics in the bar 13 as a whole. For example, when applied to a sliding door assembly such as that shown at 8 having a nominal width of six feet, the overall length of the bar lock 1 will be approximately 34 inches. Exemplary approximate dimensions for the second and first links 15 and 14 are 29 inches and 4 inches respectively, with the remaining one inch being occupied by the base 12. Length ratios of the second to first links between two to one and ten to one may be successfully employed with the bar lock 1 of the present invention.

With the relative lengths of the first and second links 14 and 15 falling within such a range of ratios, the majority of the overall length of the 13 will be occupied by the second link 15 for maximum compressive strength and buckling resistance, while allowing sufficient length of the first link 14 for the necessary length adjustments to be made. However, it is within the scope of the present invention to provide first and second links of different relative lengths, or to provide the bar lock 1 as a kit for the user to cut the links 14 and 15 to desired lengths.

In addition to the illustrated placement of the bar lock 1 on the sliding door assembly 8, various alternative placements may be employed. For example, the base 12 and the clip 50 could be mounted on the slidable member inner edge 7 whereby the second link free end 32 would engage the abutment member 3 with the bar 13 in its locked position. Also, the base 12 may be mounted in close proximity to either the top or the bottom of either the abutment member 3 or the slidable member inner edge 7. However, it is anticipated that mounting the base 12 as shown in FIG. 1 in a middle portion between the top and bottom of the abutment member 3 affords the greatest strength and convenience.

It is to be understood that while certain forms of the present invention have been illustrated and described herein, it is not to be limited to the specific forms or arrangement of parts described and shown.

What is claimed and desired to secure by Letters Patent is as follows:

1. A bar lock for use between an abutment member and a slidable member, said slidable member being movable between a closed location and an open location and defining a vertical plane, which comprises:

(a) a base including:

(1) a flange portion adapted for attachment to one of said slidable and abutment members;

(2) a clevis portion extending from said flange portion and having a pair of clevises extending in the direction of travel of said slidable member, each said clevis having an aperture therethrough and said apertures being aligned along a pivotal axis;

(3) a pivot pin positioned in said clevis portion apertures;

(b) attachment means for attaching said base flange portion to said one member;

(c) an adjustable bar comprising:

(1) a first rigid link having a pivotal end with an aperture therethrough receiving said pivot pin, a telescopic end and external threads;

(2) a tubular second rigid link having a free end, a telescopic end and a bore extending longitudinally therethrough;

(3) said second link having a plug fixedly positioned in said bore and terminating at an end flush with said second link telescopic end;

(4) said plug having a plug bore extending therethrough with internal threads thereon;

(5) said first link telescopic end being threadably received in said plug bore whereby the length of said adjustable bar may be infinitely adjusted by rotating said links relative to each other;

(6) lock means comprising a nut threadably receiving said first link and adapted for being tightened against said second link telescopic end and said plug whereby relative rotation between said links is prevented; and (7) said adjustable bar being adapted for movement about said pivotal axis extending through said pivot pin in a direction substantially normal to said plane defined by said slidable member between a locked position whereby said slidable member is locked in its closed location and a substantially upright pass position whereby said slidable member may be moved from its closed location to its open location;

(d) said movement of said bar being substantially limited to movement within said plane;

(e) a retainer clip adapted for attachment to said one of said members above said base, said clip comprising a pair of spaced arms extending from said one of said members and forming an interior cavity therebetween adapted to receive and retain said bar therein with said arms resiliently gripping said bar; and (f) a resilient cap with a cylindrical bore terminating at a blind end therein and receiving said second link free end, said cap being adapted to abut the other of said members with said bar in its locked position whereby said slidable member is tightly held in its closed location.

2. A bar lock according to claim 1 wherein:

(a) said second link has a length substantially greater than a length of a portion of said first link extending outwardly therefrom; and (b) said second link has an outside diameter substantially greater than an outside diameter of said first link.

3. In a sliding door assembly including a door jamb and a slidable member having a frame with an inner edge, said slidable member being slidable in a vertical plane of travel within said sliding door assembly, the improvement of a bar lock comprising:

(a) a base including:

(1) a flange attached to one of said door jamb and said frame inner edge;

(2) a clevis portion extending from said flange portion toward the other of said door jamb and said frame inner edge, said clevis portion having a pair of spaced-apart clevises each having an aperture therethrough, said apertures being aligned along a pivotal axis extending in a direction normal to the plane of said slidable member travel and spaced from said flange portion; and (3) a pivot pin positioned in said clevis portion apertures in alignment with said pivotal axis;

(b) attachment means attaching said base flange portion to said one of said door jamb and said frame inner edge;

(c) an adjustable bar comprising:

(1) a first rigid link having a pivotal end with an aperture therethrough receiving said pivot pin, a telescopic end and external threads;

(2) a tubular second rigid link having a free end, a telescopic end and a bore extending coaxially therethrough;

(3) said second link having a plug fixedly positioned in said bore and terminating at an end flush with said second link telescopic end;

(4) said plug having a plug bore extending coaxially therethrough with internal threads thereon;

(5) said first link telescopic end being threadably received in said plug bore whereby the length of said adjustable bar may be infinitely adjusted by rotating said links relative to each other;

(6) a wing nut threadably receiving said first link and adapted for being tightened against said second link telescopic end and said plug end whereby relative rotation between said links is prevented; and (7) said adjustable bar being adapted for movement about said pivotal axis extending through said pivot pin between a locked position whereby said slidable member is locked in its closed location and a substantially upright pass position whereby said slidable member may be moved from its closed location to its open location;

(d) said movement of said bar being substantially limited to movement within said plane of slidable member travel;

(e) a retainer clip attached to said one of said door jamb and said frame inner edge above said base, said clip comprising a pair of spaced arms forming an interior cavity therebetween adapted to receive and retain said bar therein with said arms resiliently gripping said bar;

(f) a resilient cap having a cylindrical bore terminating at a closed end and receiving said second link free end;

(g) the total length of said bar lock being slightly greater than the spacing between said door jamb and said frame inner edge with said slidable member in its closed location whereby said adjustable bar extends at a slight angle from horizontal with said resilient cap abutting one of said door jamb and said frame inner edge at a position slightly above said pivotal axis; and (h) a resilient bumper attached to said one of said door jamb and said frame inner edge below said base, said bumper extending toward the other of said door jamb and said frame inner edge a greater distance than the projection of said bar lock in its pass position whereby said bar lock is spaced from said frame inner edge with said slidable member in its open location.

* * * * *